US010094196B2

(12) United States Patent
Faugstad

(10) Patent No.: US 10,094,196 B2
(45) Date of Patent: Oct. 9, 2018

(54) ROTATING CONTROL DEVICE

(71) Applicant: FA SOLUTIONS AS, Skogsvaag (NO)

(72) Inventor: Ketil Faugstad, Skogsvaag (NO)

(73) Assignee: FA SOLUTIONS AS, Skogsvaag (NO)

( * ) Notice: Subject to any disclaimer, the term of this patent is extended or adjusted under 35 U.S.C. 154(b) by 258 days.

(21) Appl. No.: 15/055,344

(22) Filed: Feb. 26, 2016

(65) Prior Publication Data

US 2017/0247972 A1 Aug. 31, 2017

(51) Int. Cl.

| | |
|---|---|
| ***E21B 33/04*** | (2006.01) |
| ***E21B 33/08*** | (2006.01) |
| ***E21B 21/08*** | (2006.01) |
| ***E21B 21/10*** | (2006.01) |
| ***E21B 33/06*** | (2006.01) |
| ***E21B 33/068*** | (2006.01) |

(52) U.S. Cl.

CPC ..... *E21B 33/085* (2013.01); *E21B 21/08* (2013.01); *E21B 21/106* (2013.01); *E21B 33/06* (2013.01); *E21B 33/068* (2013.01)

(58) Field of Classification Search

CPC ..... E21B 33/0415; E21B 33/085

USPC ..... 277/326, 332; 166/84.3, 84.1, 85.4; 251/1.2, 1.1

See application file for complete search history.

(56) References Cited

U.S. PATENT DOCUMENTS

| | | | | |
|---|---|---|---|---|
| 1,942,366 | A | 1/1934 | Seamark | |
| 5,224,557 | A | 7/1993 | Yenulis et al. | |
| 6,244,359 | B1 * | 6/2001 | Bridges | E21B 21/001 166/358 |
| 6,554,016 | B2 * | 4/2003 | Kinder | E21B 33/085 137/12 |
| 2001/0050185 | A1 | 12/2001 | Calder et al. | |
| 2005/0061499 | A1 * | 3/2005 | Hopper | E21B 33/085 166/84.3 |
| 2009/0139724 | A1 | 6/2009 | Gray et al. | |
| 2013/0192896 | A1 * | 8/2013 | Bailey | E21B 33/085 175/57 |
| 2017/0016303 | A1 * | 1/2017 | Clark | E21B 33/085 |

OTHER PUBLICATIONS

International Search Report and Written Opinion issued in International Patent Application No. PCT/EP2016/058530, dated Jan. 17, 2017 (18 pages).

* cited by examiner

*Primary Examiner* — Kenneth L Thompson
(74) *Attorney, Agent, or Firm* — Adolph Locklar

(57) ABSTRACT

An RCD includes a housing, a seal assembly package, and a seal tube assembly. The seal tube assembly includes a seal tube, a seal, a first bearing, and a second bearing. The seal is coupled between the first and second bearings. The first bearing includes a flow path between the interior of the seal tube and the annular space between the seal and the seal tube. The SAP includes an SAP outer body positioned within the housing and fluidly sealed thereto. The RCD may include a running tool coupled to the SAP having one or more grippers for engaging a tool string passing through the RCD.

10 Claims, 12 Drawing Sheets

ROTATING CONTROL DEVICE

TECHNICAL FIELD/FIELD OF THE DISCLOSURE

The present disclosure relates to managed pressure drilling devices, and specifically to rotating control devices.

BACKGROUND OF THE DISCLOSURE

When drilling a wellbore, fluids in the underground formation surrounding the wellbore are under pressure. In order to prevent their flow into the wellbore, drilling fluid, commonly known as drilling mud, is introduced into the wellbore. The hydrostatic pressure of the drilling mud against the wellbore may be used to prevent the fluid from entering the wellbore. When the hydrostatic pressure of the drilling mud equals the formation pressure, the drilling operation is typically referred to as balanced. Typically, a wellbore is drilled slightly overbalanced, such that the hydrostatic pressure of the drilling mud is higher than the formation pressure.

However, if the hydrostatic pressure of the drilling mud falls below the formation pressure, an underbalanced condition, fluid from the formation may flow into the wellbore. This increase in fluid flow is known as a kick. If a kick is not contained, a blowout may occur. Kicks may be caused by insufficient mud weight, improper hole fill-up during trips, swabbing, gas cut mud, or lost circulation. In order to reduce the risk of blowouts, drilling rigs utilize pressure control devices such as blow out preventers, choke manifolds, Kelly-Cocks, and flapper discs.

In some drilling operations, a rotating control device may be utilized to route drilling mud returning up the annulus of the wellbore to mud process equipment. The RCD may seal against the wellbore and the rotating drill string which passes therethrough. An RCD may be used during, for example, managed pressure drilling in which the hydrostatic pressure of the drilling mud may be monitored and actively regulated based on encountered conditions in the wellbore.

SUMMARY

The present disclosure provides for a rotating control device (RCD). The RCD may include a housing. The RCD may include a seal assembly package (SAP), including an SAP outer body. The SAP outer body may form a fluid seal against the housing. The RCD may include a seal tube assembly. The seal tube assembly may include a seal tube, the seal tube mechanically coupled to the SAP. The seal tube assembly may include a seal, the seal being tubular; a first bearing mechanically coupled between the seal tube and a first end of the seal; and a second bearing mechanically coupled between the seal tube and a second end of the seal.

The present disclosure also provides for a seal tube assembly. The seal tube assembly may include a seal tube; a seal, the seal being tubular; a first bearing mechanically coupled between the seal tube and a first end of the seal; and a second bearing mechanically coupled between the seal tube and a second end of the seal.

The present disclosure also provides for a running tool. The running tool may include a running tool body. The running tool body may be generally annular. The running tool may include an activation ring. The activation ring may be slidingly coupled to the running tool body. The activation ring may have a run in position and a locked position. The running tool may include a gripper pivotably coupled to the running tool body. The gripper may be pivotable from a gripping position when the activation ring is in the run in position and a released position when the activation ring is in the locked position

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
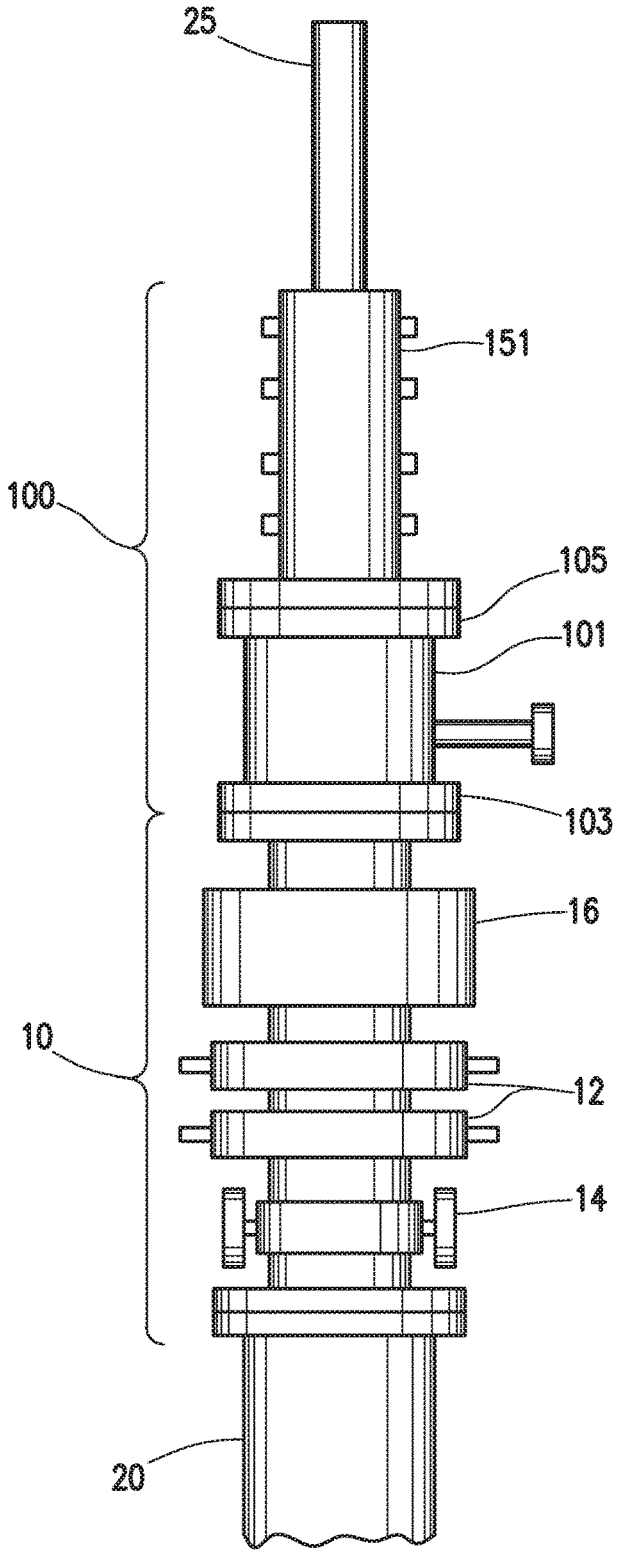
FIG. 1 depicts an overview of a BOP stack and RCD consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts rotating control device (RCD) 100. In some embodiments, RCD 100 may be positioned atop blowout preventer (BOP) stack 10. BOP stack 10 may couple between RCD 100 and casing 20 which may extend into a wellbore. BOP stack 10 may include, for example and without limitation, one or more rams 12, spools 14, annular preventers 16, and other components. Drill string 25 may extend through BOP stack 10 and RCD 100 into casing 20.

Figure 2:
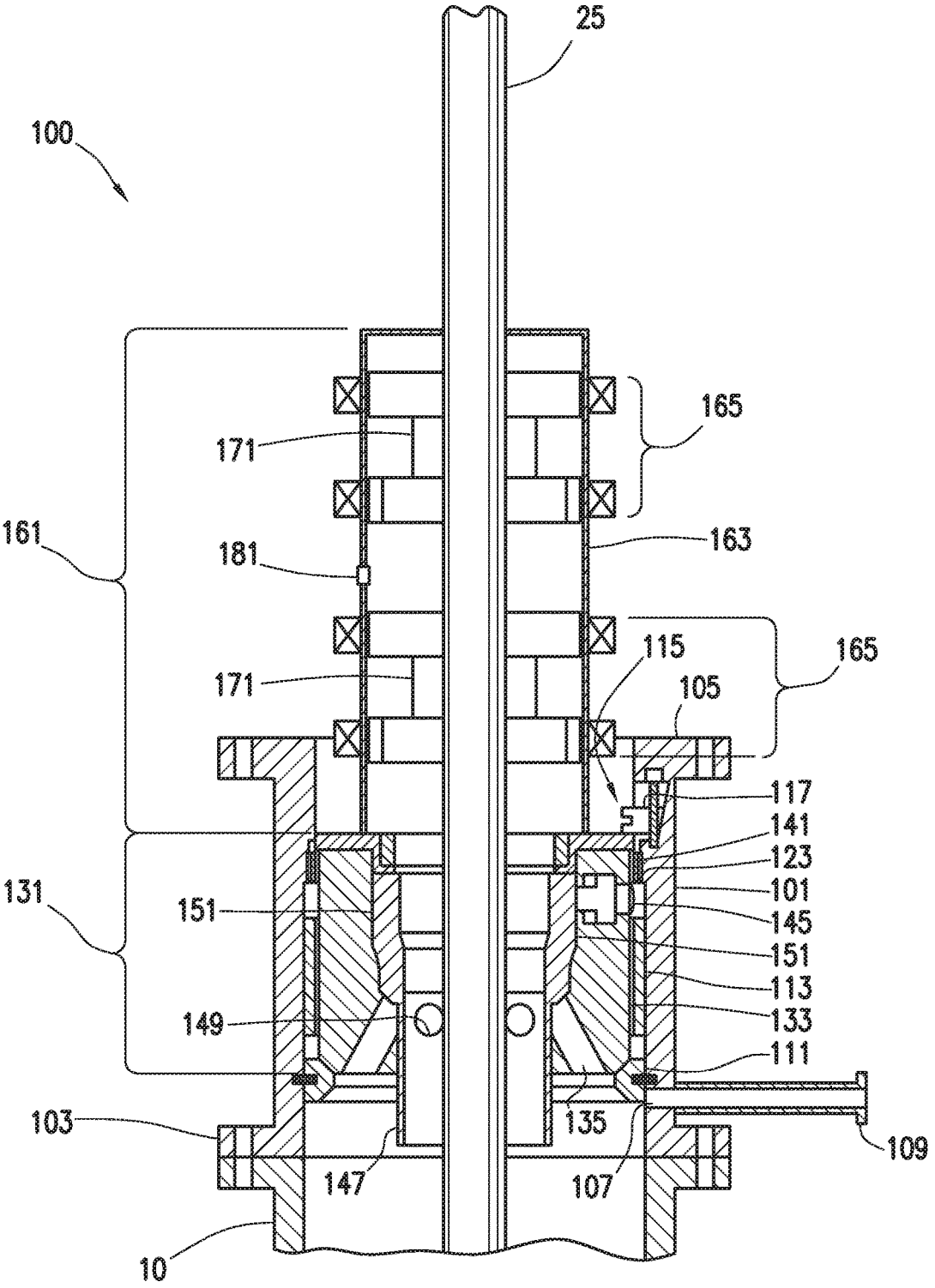
FIG. 2 depicts a cross section view of the RCD of FIG. 1.

As depicted in FIG. 2, in some embodiments, RCD 100 may include housing 101, seal assembly package (SAP) 131, and seal tube assembly 161. Housing 101 may include lower flange 103, adapted to couple to another component, such as BOP stack 10. In some embodiments, housing 101 may be sealingly coupled to BOP stack 10, such that the interior of housing 101 is in fluid communication with the wellbore through BOP stack 10. In some embodiments, housing 101 may include upper flange 105, which may be used to couple RCD 100 to another component, such as a riser section as discussed further herein below. For example and without limitation, upper flange 105 may be used to couple RCD 100 to one or more of a pump, washing device, or wiper. In some embodiments, upper flange 105 may not be connected to any additional component.

In some embodiments, housing 101 may further include one or more ports 107. Ports 107 may act as inlets and outlets through which fluid may flow. In some embodiments, ports 107 may fluidly couple to flanges 109, to which other equipment may be coupled, such as, for example and without limitation, choke manifolds, pressure gauges, static flow check equipment, valves, etc.

Figure 3:
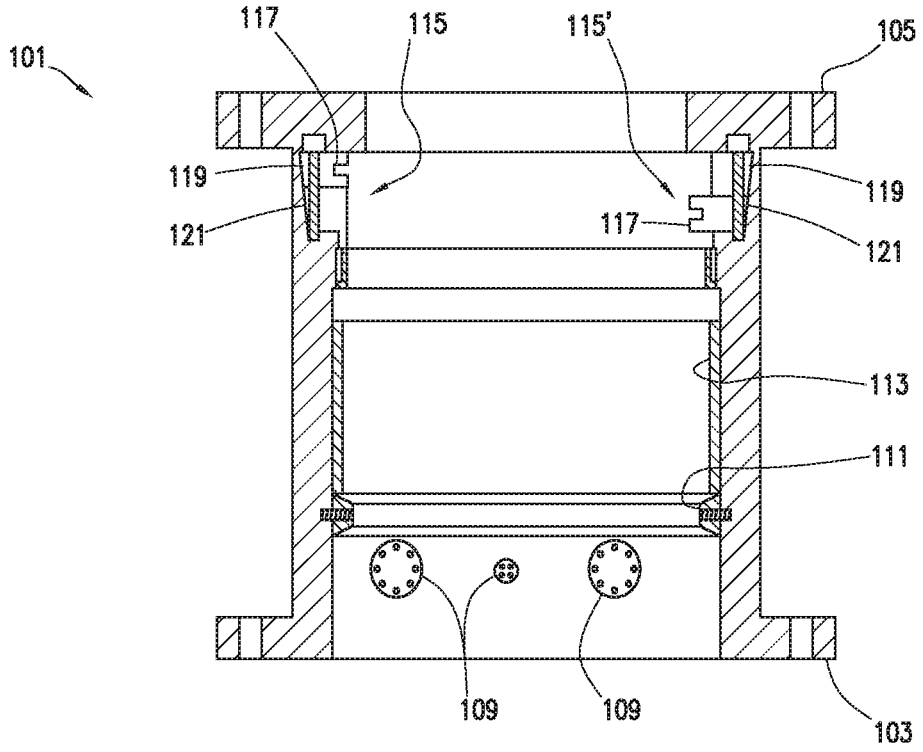
FIG. 3 depicts a cross section view of a housing of the RCD of FIG. 1.

In some embodiments, as depicted in FIGS. 2, 3, housing 101 may include landing ring 111. Landing ring 111 may be a ridge, step, or other projection into the interior of housing 101. Landing ring 111 may abut and seal against a lower edge of SAP 131 as further discussed herein below. In some embodiments, housing 101 may include sleeve 113 positioned on an interior surface thereof. Sleeve 113 may abut and seal against an outer surface of SAP 131 as further discussed herein below. Sleeve 113 may be replaceable. Sleeve 113 may be formed from a material having high resistance to wear, including, for example and without limitation, a ceramic material. In some embodiments, landing ring 111 may include surface treatment such as a hard coating to, for example and without limitation, reduce wear on landing ring 111.

In some embodiments, housing 101 may include locking mechanism 115. Locking mechanism 115 may be operated manually, pneumatically, hydraulically, or electrically to lock SAP 131 to housing 101 as further discussed herein below. Locking mechanism 115 may include locking pawl 117 positioned within locking recess 119. Locking recess 119, in some embodiments, may include sloped surface 121, against which locking pawl 117 is pressed. As locking mechanism 115 goes from an open position (shown on the left half of FIG. 3) to a locked position (shown on the right half of FIG. 3 and indicated as locking mechanism 115'), sloped surface 121 may extend locking pawl 117 inward and toward landing ring 111 in housing 101.

In some embodiments, as depicted in FIG. 2, SAP 131 may include SAP outer body 133. SAP outer body 133 may include one or more fluid passages 135 through which fluid may flow from, in some embodiments, the interior of SAP outer body 133 and the lower surface 137 of SAP outer body 133. SAP outer body 133 may be positionable within housing 101. In some embodiments, lower surface 137 may, when SAP 131 is installed in housing 101, abut landing ring 111 and seal thereagainst. SAP outer body 133 may include outer surface 139, which may, when installed in housing 101, abut sleeve 113 and seal thereagainst.

Figure 4:
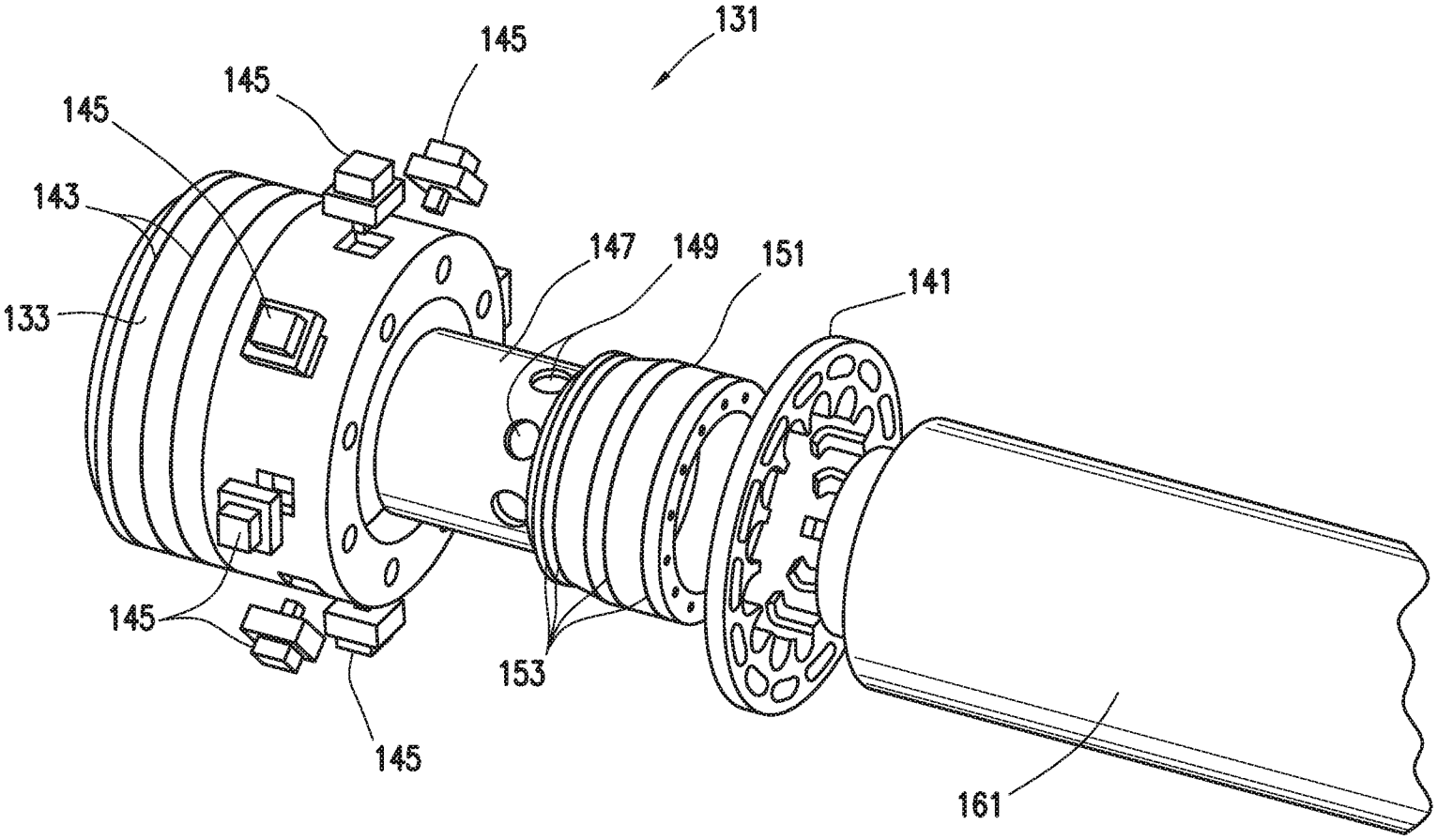
FIG. 4 depicts a perspective exploded view of a seal assembly package of the RCD of FIG. 1.

In some embodiments, as depicted in FIG. 4, SAP 131 may include one or more outer seals 143 which may assist the fluid seal between SAP 131 and housing 101 (not shown).

Mandrel 147 may be generally tubular. Mandrel 147 may include one or more apertures 149 positioned to fluidly couple the interior of mandrel 147 with the exterior of mandrel 147. Mandrel 147 may be coupled to SAP inner body 151. SAP inner body 151 may be positionable within SAP outer body 133. SAP inner body 151 may include one or more seals 153 positioned to fluidly seal against SAP outer body 133 when SAP inner body 151 is positioned therein as depicted in FIG. 2.

Figure 5:
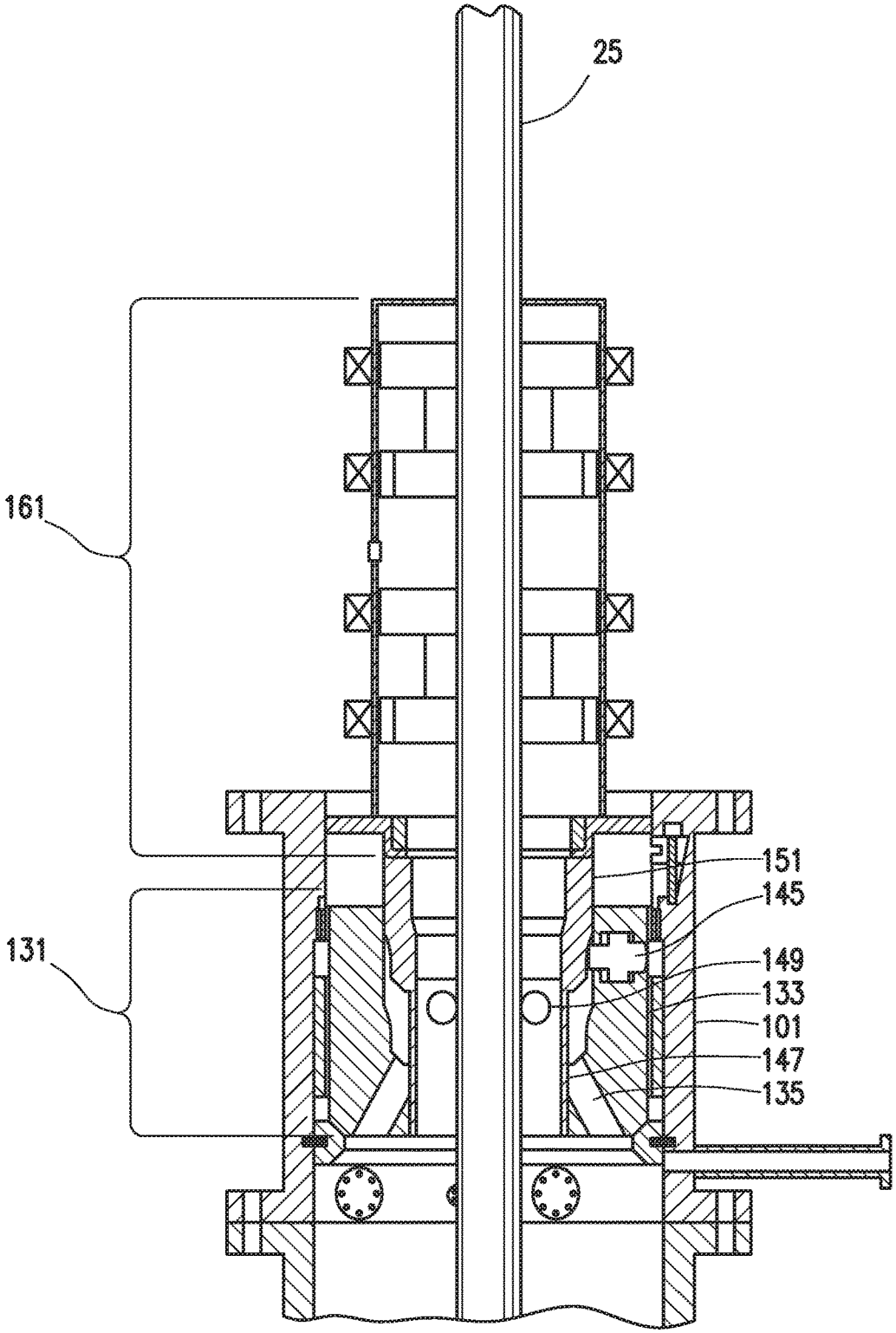
FIG. 5 depicts a cross section view of the RCD of claim 1.

In some embodiments, SAP inner body 151 may be moved from a locked position as depicted in FIG. 2 to a run in position as depicted in FIG. 5. In some embodiments, when in the locked position as depicted in FIG. 2, fluid passages 135 may be closed off. When in the run in position as depicted in FIG. 5, fluid passages 135 may be fluidly coupled to the interior of mandrel 147 through apertures 149. In some embodiments, SAP 131 may include one or more locking bolts 145 slidingly positioned in SAP outer body 133. Locking bolts 145 may extend from an outer surface of SAP outer body 133 when SAP inner body 151 is in the locked position. Locking bolts 145 may, when extended as depicted in FIG. 2, engage lip 123 of housing 101, to lock SAP 131 in housing 101. SAP inner body 151 may abut an inner surface of locking bolts 145 when in the locked position, extending locking bolts 145. When SAP inner body 151 is in the run in position as depicted in FIG. 5, locking bolts 145 may be retracted, unlocking SAP outer body 133 from housing 101.

In some embodiments, SAP 131 may include locking ring 141 mechanically coupled to the upper surface of SAP inner body 151. Locking ring 141 may, when SAP 131 is positioned within housing 101, be engaged by locking pawl 117 of locking mechanism 115. Downward force from locking pawl 117 may compress SAP inner body 151 into SAP outer body 133 and SAP outer body 133 against landing ring 111, thus locking SAP 131 to housing 101.

Figure 9A:
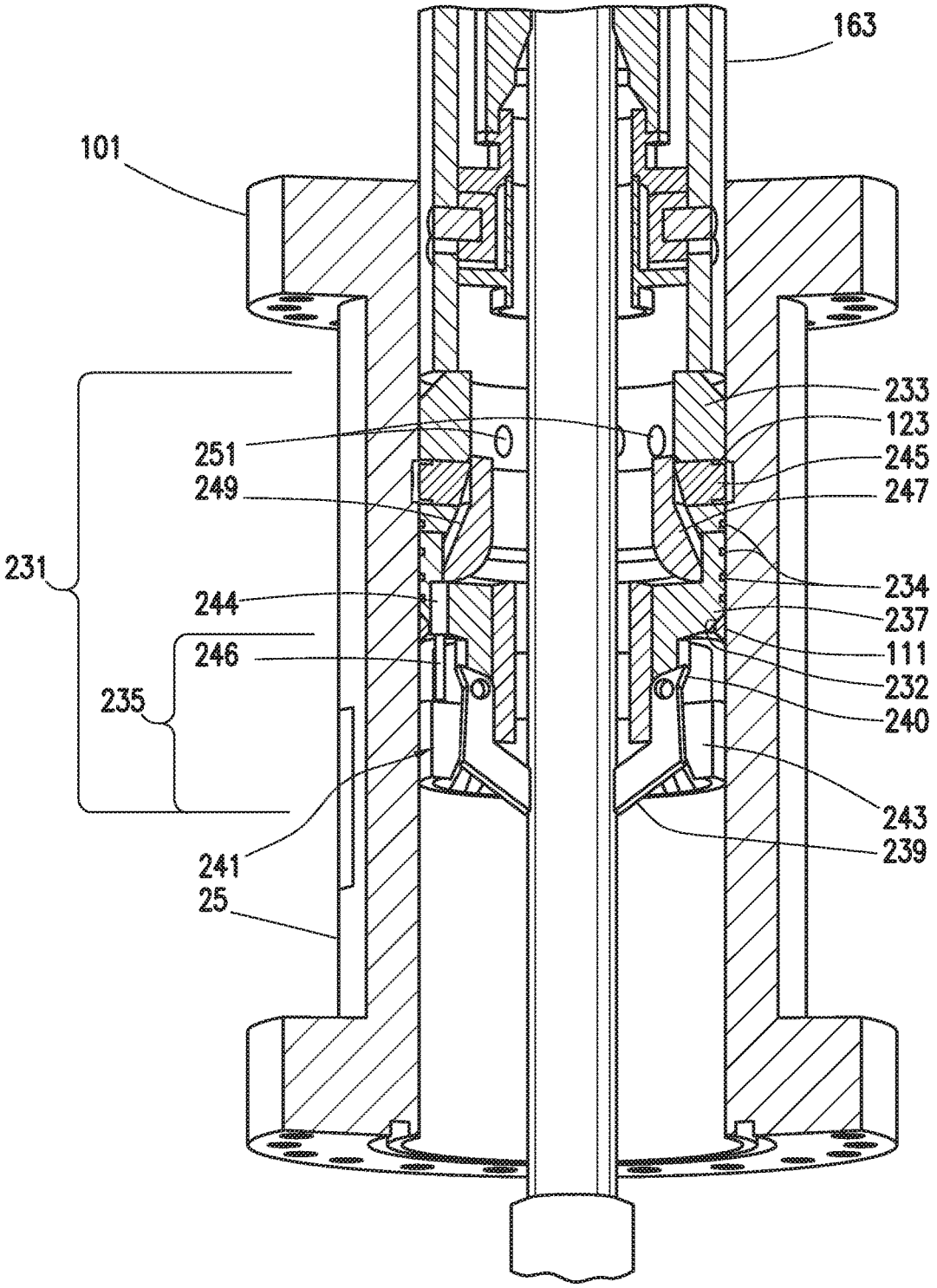
FIGS. 9A, 9B depict sectional views of an RCD consistent with at least one embodiment of the present disclosure.
Figure 9B:
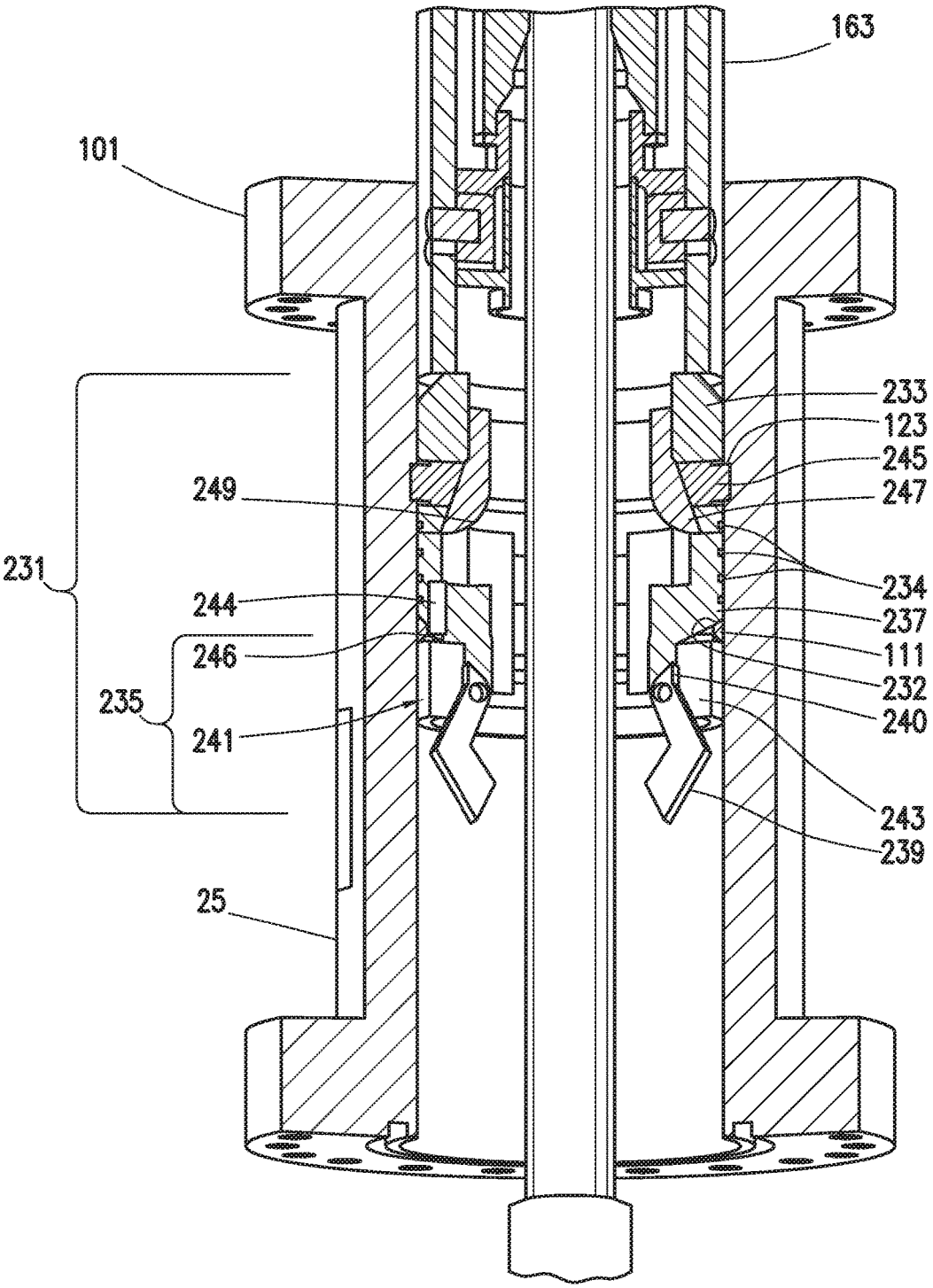

In some embodiments, as depicted in FIGS. 9A and 9B, SAP 231 may include SAP outer body 233. SAP outer body 233 may be generally annular in shape. In some embodiments, seal tube 163 may be coupled to SAP outer body 233. In some embodiments, SAP outer body 233 may, when installed to housing 101, form a fluid seal thereagainst. In some embodiments, one or more seals 234 may be positioned on an exterior surface of SAP outer body 233.

In some embodiments, SAP 231 may include running tool 235. Although described with respect to SAP 231 of RCD 100, one having ordinary skill in the art with the benefit of this disclosure will understand that running tool 235 may be used with equipment other than an RCD as described herein. In some embodiments, running tool 235 may include running tool body 237. Running tool body 237 may be generally annular in shape. Running tool body 237 may be mechanically coupled to SAP outer body 233. Although described and depicted as separate components, one having ordinary skill in the art with the benefit of this disclosure will understand that SAP outer body 233 and running tool body 237 may be formed as a single unit or from any number of subcomponents. In some embodiments, SAP 231 may include landing surface 232 positioned to abut landing ring 111 of housing 101 when SAP 231 is positioned therein.

In some embodiments, running tool 235 may include grippers 239. Grippers 239 may be pivotably coupled to running tool body 237. In some embodiments, running tool body 237 may include one or more gripper slots 241 into which grippers 239 may be positioned. In some embodiments, grippers 239 may be movable from a gripping position as depicted in FIG. 9A to a released position as depicted in FIG. 9B. In the gripping position, grippers 239 may engage an outer surface of drill string 25, and in the released position may release drill string 25.

In some embodiments, grippers 239 may be moved from the gripping position to the released position and vice versa by activation ring 243. Activation ring 243 may move longitudinally along the outer surface of grippers 239. Grippers 239 and activation ring 243 may be in contact such that as activation ring 243 is moved from a run in position as depicted in FIG. 9A to a locked position as depicted in FIG. 9B, grippers 239 may retract from drill string 25. In some embodiments, as activation ring 243 is moved from the locked position to the run in position, grippers 239 are pressed radially inward against drill string 25. In some embodiments, grippers 239 may be retracted by, for example and without limitation, one or more springs (not shown) or by a mechanical coupling between grippers 239 and activation ring 243. In some embodiments, each gripper 239 may include retraction ramp 240. Retraction ramp 240 may be a camming surface in contact with activation ring 243 such that activation ring 243 presses against retraction ramp 240 as it is moved to the locked position, causing grippers 239 to retract radially away from drill string 25.

In some embodiments, activation ring 243 may be moved between the locked position and the run in position by a hydraulic or pneumatic cylinder and piston between running tool body 237 and activation ring 243, depicted schematically in FIGS. 9A, 9B as cylinder 244 and piston 246. In some embodiments, one or more flow paths may be formed through housing 101 to supply fluid to cylinder 244. In some embodiments, activation ring 243 may be moved between the locked position and the run in position by the weight of SAP 231 or drill string 25.

In some embodiments, SAP 231 may include one or more locking bolts 245 positioned in SAP outer body 233 which may extend from an outer surface of SAP outer body 233 when SAP 231 is in the locked position as depicted in FIG. 9B. Locking bolts 245 may, when extended as depicted in FIG. 9B, engage lip 123 of housing 101, to lock SAP 231 in housing 101. In some embodiments, when SAP 231 is in the run in position as depicted in FIG. 9A, locking bolts 245 may be retracted, allowing SAP 231 to be removed from housing 101 as described herein below.

In some embodiments, SAP 231 may include SAP inner body 247. SAP inner body 247 may be generally annular and may be slidingly positioned within SAP outer body 233. In some embodiments, SAP inner body 247 may be mechanically coupled to activation ring 243 and may move longitudinally from a run in position as depicted in FIG. 9A to a locked position as depicted in FIG. 9B. In some embodiments, as SAP inner body 247 is moved from the run in position to the locked position, an outer surface 249 of SAP inner body 247 may abut locking bolts 245, causing them to extend from SAP outer body 233 as depicted in FIG. 9B. In some embodiments, as SAP inner body 247 is moved from the locked position to the run in position, outer surface 249 of SAP inner body 247 may be removed from locking bolts 245, allowing locking bolts 245 to retract into SAP outer body 233 as depicted in FIG. 9A.

In some embodiments, in order to install SAP 231 to housing 101, SAP 231 may be positioned in the run in position on drill string 25. Grippers 239 may engage the outer surface of drill string 25, allowing SAP 231 to be supported by drill string 25. Grippers 239 may be engaged to the outer surface of drill string 25 by activation ring 243 as discussed herein above. Drill string 25 and SAP 231 may then be lowered into housing 101 until include landing surface 232 abuts landing ring 111 of housing 101. SAP 231 may then be reconfigured into the locked position. In some embodiments, activation ring 243 may be moved to the locked position, allowing grippers 239 to disengage the outer surface of drill string 25. In some embodiments, SAP inner body 247 may move from the run in position to the locked position, extending locking bolts 245 from SAP outer body 233 to engage lip 123 of housing 101, locking SAP 231 in housing 101.

In some embodiments, in order to remove SAP 231 from housing 101, SAP 231 may be moved from the locked position to the run in position. SAP inner body 247 may move from the locked position to the run in position, allowing locking bolts 245 to retract from lip 123 of housing 101, unlocking SAP 231 from housing 101. Activation ring 243 may be moved from the locked position to the run in position as previously discussed, causing grippers 239 to engage the outer surface of drill string 25, allowing SAP 231 to be supported by drill string 25. Drill string 25 may then be raised, removing SAP 231 from housing 101.

In some embodiments, one or more apertures 251 may be formed in SAP outer body 233 which provide a flow path between the interior and exterior wall of SAP outer body 233. In some embodiments, as SAP 231 is installed to or removed from housing 101, fluid may flow through apertures 251 of SAP outer body 233, thereby reducing any fluid pressure effects including, for example and without limitation, swabbing or surging. In some embodiments, when SAP 231 is in the locked position, apertures 251 may be closed off, preventing fluid flow therethrough. In some embodiments, when SAP inner body 247 is in the locked position as depicted in FIG. 9B, SAP inner body 247 may be positioned to close apertures 251.

Figure 6A:
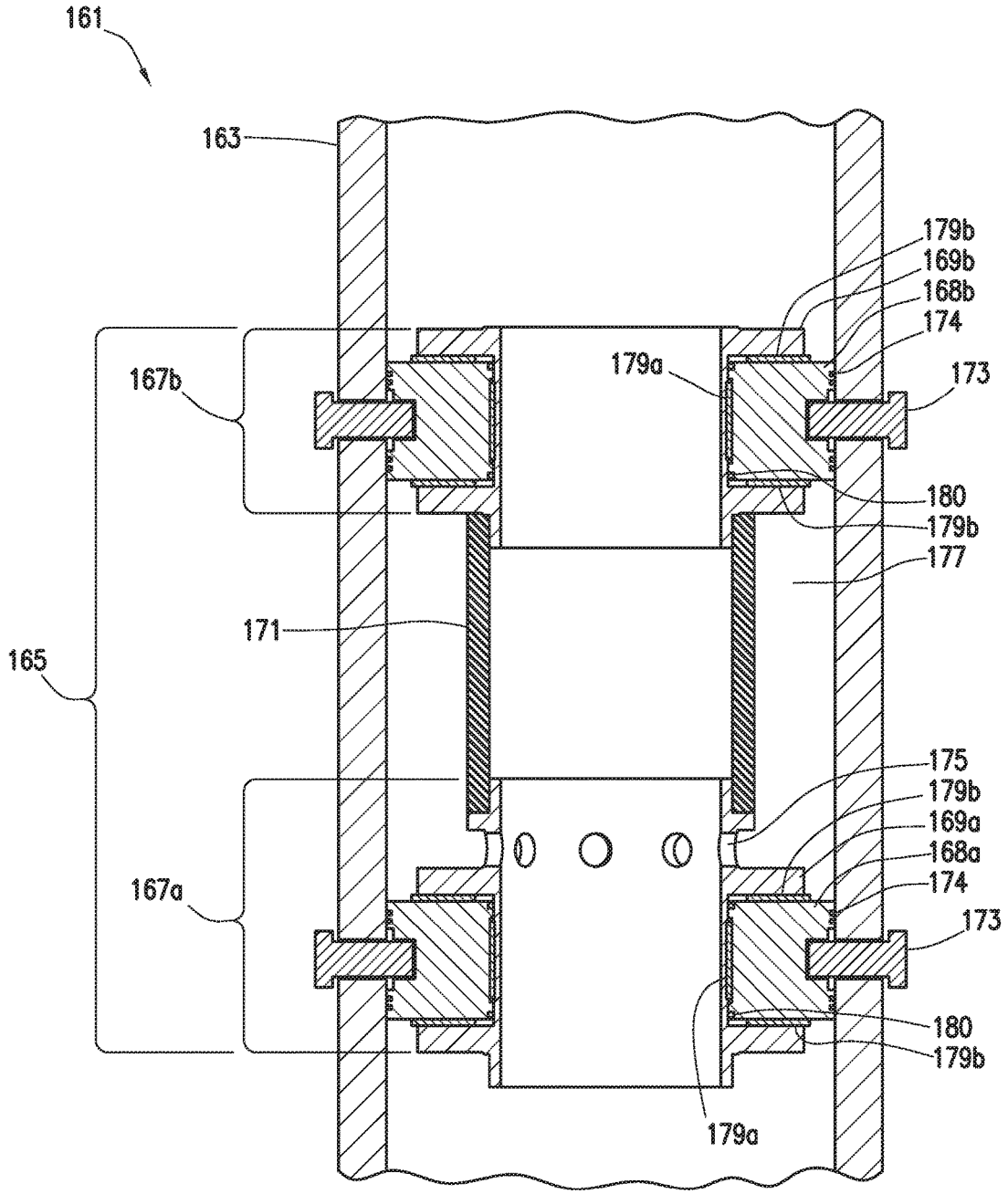
FIGS. 6A, 6B depict a bearing assembly consistent with at least one embodiment of the present disclosure.
Figure 6B:
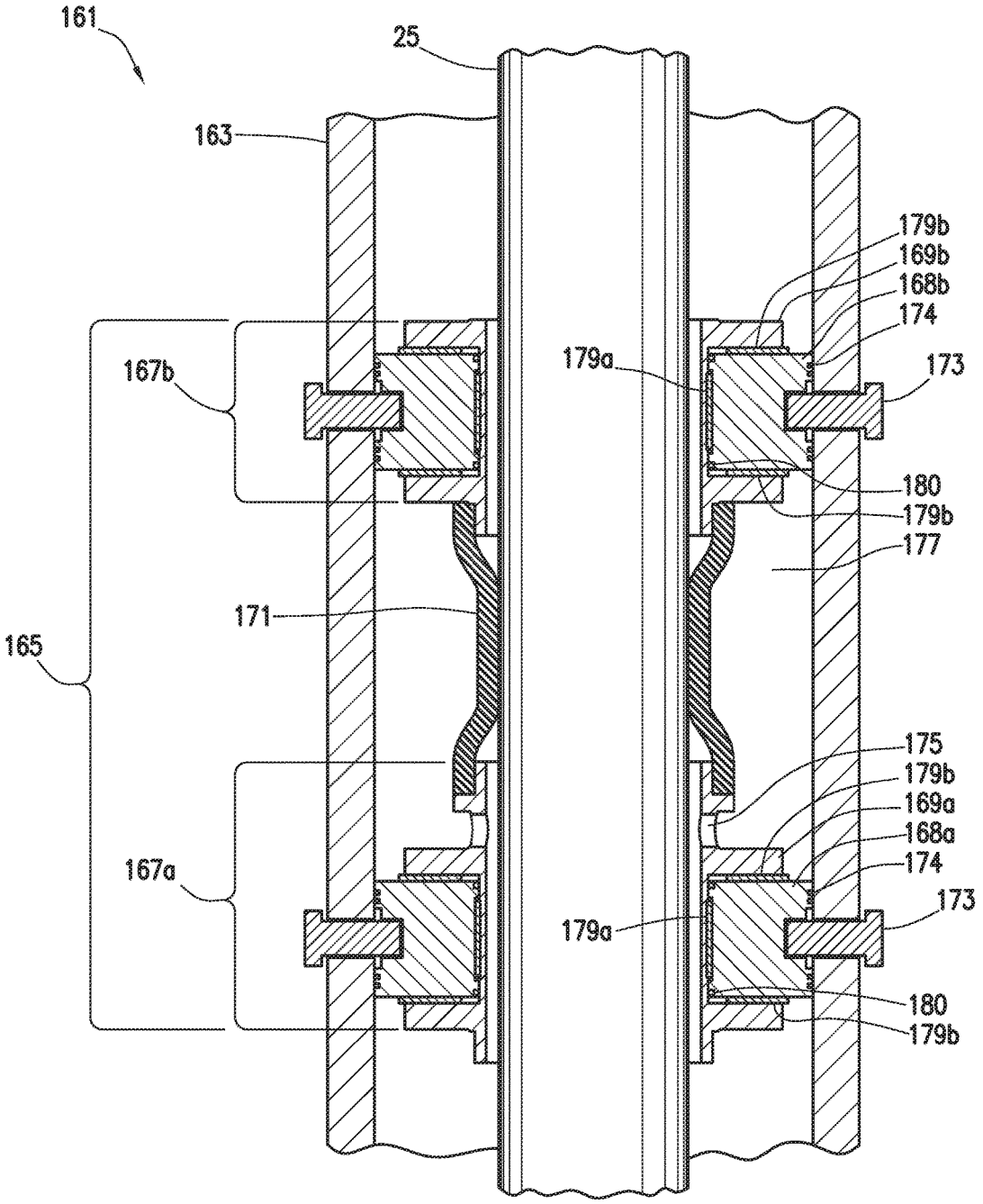

In some embodiments, SAP 131, as depicted in FIG. 2, may mechanically couple to seal tube assembly 161. In some embodiments, seal tube assembly 161 may include seal tube 163 and bearing assembly 165. Bearing assembly 165, as depicted in FIGS. 6A and 6B, may include a first bearing referred to herein as lower bearing 167*a*, a second bearing referred to herein as upper bearing 167*b*, and seal 171. Lower bearing 167*a* may include lower bearing holder 168*a* and lower bearing race 169*a*. Upper bearing 167*b* may include upper bearing holder 168*a* and upper bearing race 169*b*. Lower bearing holder 168*a* and upper bearing holder 168*b* may be mechanically coupled to seal tube 163 by, for example and without limitation, bolts 173, although one having ordinary skill in the art with the benefit of this disclosure will understand that any mechanical connection may be used.

In some embodiments, lower bearing race 169*a* may rotate relative to lower bearing holder 168*a* and upper bearing race 169*b* may rotate relative to upper bearing holder 168*b*. In some embodiments, one or more seals 180 may be positioned between lower bearing holder 168*a* and lower bearing race 169*a* and between upper bearing holder 168*b* and upper bearing race 169*b*. In some embodiments, each of lower bearing 167*a* and upper bearing 167*b* may include one or more rotary bearings 179*a* and one or more thrust bearings 179*b* positioned to, for example and without limitation, reduce friction between lower bearing holder 168*a* and lower bearing race 169*a* and between upper bearing holder 168*b* and upper bearing race 169*b* when force is placed against bearing assembly 165 in a radial or longitudinal direction. In some embodiments, for example and without limitation, rotary bearings 179*a* and thrust bearings 179*b* may be one or more of a roller, ball, needle, or any other kind of bearing. In some embodiments, bearing holders 168*a*, 168*b* may radially extend from the inner surface of seal tube 163 to, for example and without limitation, reduce the size of rotary bearings 179*a* and thrust bearings 179*b* of lower bearing 167*a* and upper bearing 167*b*, which may reduce the overall force exerted on lower bearing 167*a* and upper bearing 167*b* from fluid pressure in annular space 177.

Seal 171 may be tubular. Seal 171 may be mechanically coupled between lower bearing race 169*a* at a first end of seal 171 and upper bearing race 169*b* at a second end of seal 171, such that seal 171 may rotate relative to seal tube 163. Seal 171 may be fluidly sealed to lower bearing 167*a* and upper bearing 169*b*. In some embodiments, seal 171 may be formed from an elastomeric material such that it may conform to the contour of drill string 25 (as in FIG. 6B) as it passes therethrough, including any tools coupled thereto. In some embodiments, seal 171 may be formed from, for example and without limitation, rubber or plastic.

In some embodiments, the size of seal 171 may be selected based at least in part on the diameter of drill string 25 to be used. In some embodiments, the thickness of seal 171 may be selected based at least in part on the expected fluid pressure to be encountered. For example, by making seal 171 have a larger outer diameter, the force applied by seal 171 on drill string 25 may increase because of the increased surface area of seal 171, which may, for example and without limitation, increase the strength of the seal between seal 171 and drill string 25 from a thinner seal 171.

In some embodiments, lower bearing 167*a* and upper bearing 167*b* may fluidly seal to seal tube 163. In some embodiments, one or more seals 174 may be positioned between lower bearing 167*a* and seal tube 163 and between upper bearing 169*b* and seal tube 163. In some embodiments, lower bearing 167*a* may include one or more flow paths 175 between the interior of seal tube 163 below lower bearing 167*a* and annular space 177 bounded by lower bearing 167*a*, upper bearing 169*b*, seal tube 163 and seal 171. The interior of seal tube 163 below lower bearing 167*a* may be in fluid communication with the interior of casing 20. Fluid pressure in annular space 177 may act on the exterior of seal 171, causing it to press against drill string 25 and form a seal as depicted in FIG. 6B.

In some embodiments, drill string 25 may include one or more portions of higher diameter than the rest of drill string 25, such as, for example and without limitation, tool joints between adjacent sections of the pipe which makes up drill string 25. In some embodiments, seal tube 163 may be filled with a fluid above bearing assembly 165. In some such embodiments, as a tool joint passes through seal 171, fluid from within seal tube 163 above bearing assembly 165 may be pulled downward by, for example and without limitation, a vacuum created by the tool joint as it passes through seal 171.

Figure 8A:
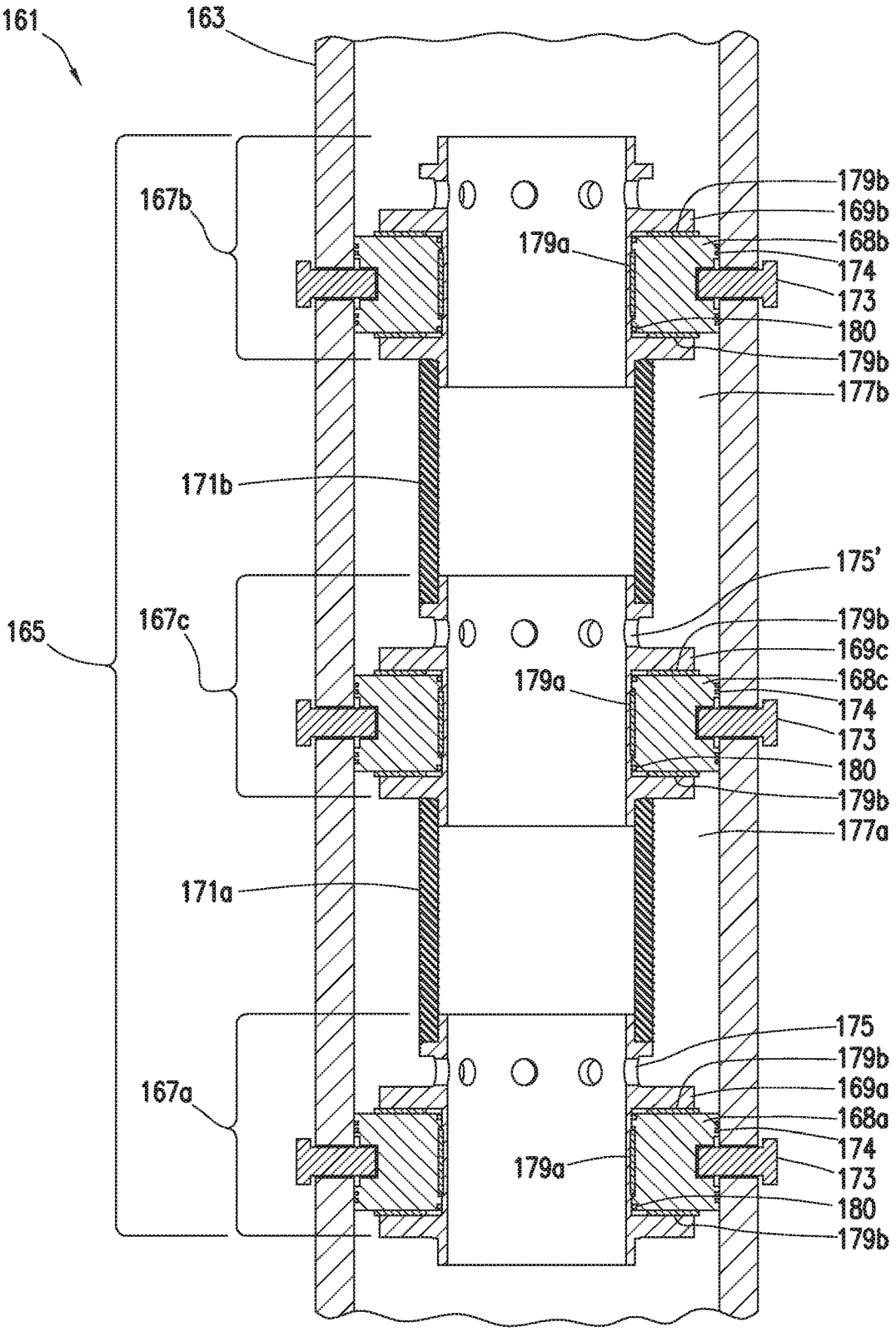
FIGS. 8A, 8B depict a bearing assembly consistent with at least one embodiment of the present disclosure.
Figure 8B:
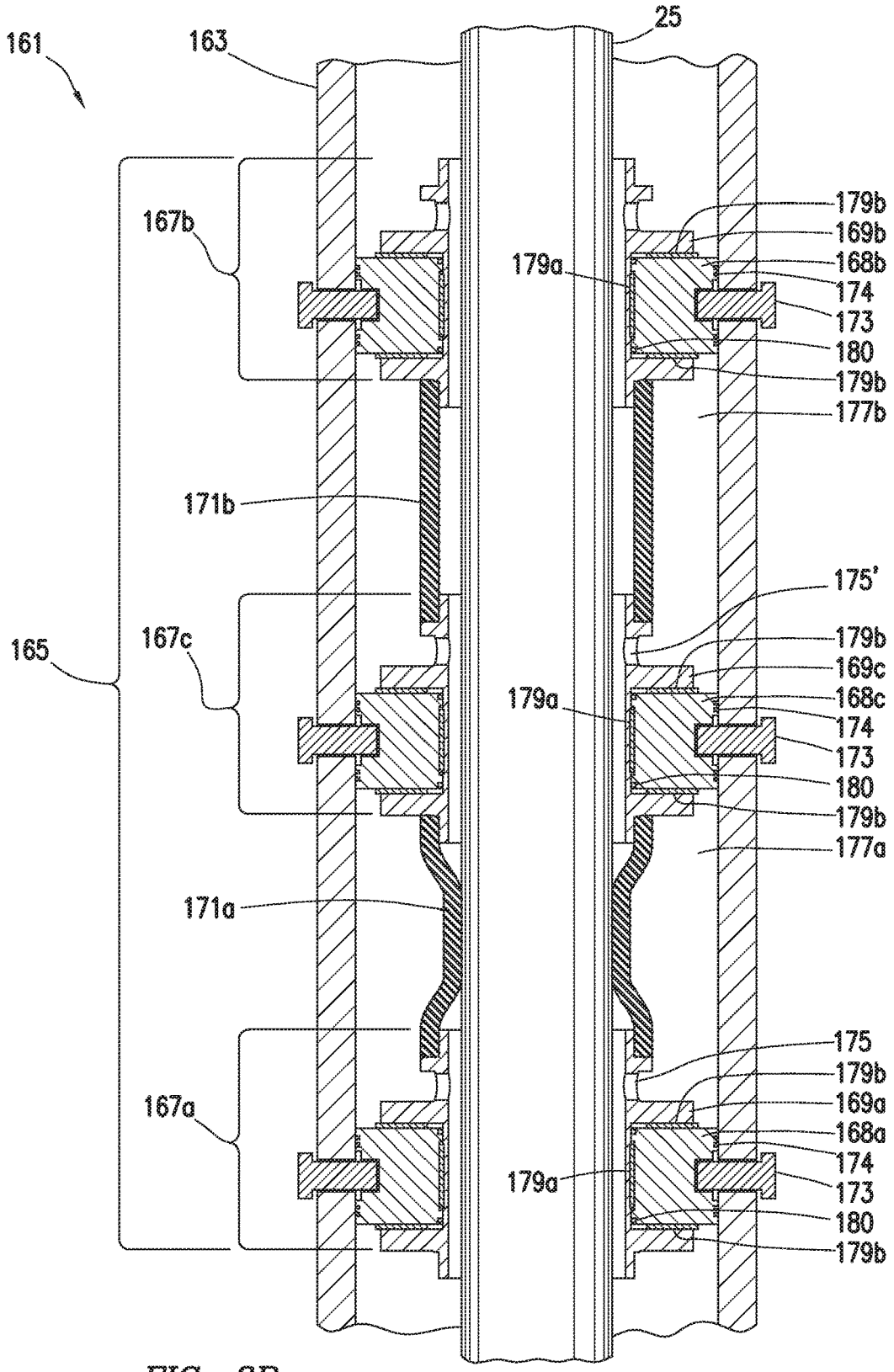

In some embodiments, each bearing assembly 165 may include a single seal 171. In some embodiments, bearing assembly 165 may include multiple seals 171. For example, as depicted in FIGS. 8A and 8B, in some embodiments, bearing assembly may include a third bearing, depicted as intermediate bearing 167*c*. Intermediate bearing 167*c* may include intermediate bearing holder 168*c* and intermediate bearing race 169*c*. Intermediate bearing holder 168*c* may be mechanically coupled to seal tube 163 by, for example and without limitation, bolts 173, although one having ordinary skill in the art with the benefit of this disclosure will understand that any mechanical connection may be used. In some embodiments, more than three bearings may be utilized.

In some embodiments, intermediate bearing race 169*c* may rotate relative to intermediate bearing holder 168*c*. In some embodiments, one or more seals 180 may be positioned between intermediate bearing holder 168*c* and intermediate bearing race 169*c*. In some embodiments, intermediate bearing 167*c* may include one or more rotary bearings 179*a* and one or more thrust bearings 179*b* positioned to, for example and without limitation, reduce friction between intermediate bearing holder 168*c* and intermediate bearing race 169*c* when force is placed against bearing assembly 165 in a radial or longitudinal direction. In some embodiments, for example and without limitation, rotary bearings 179*a* and thrust bearings 179*b* may be one or more of a roller, ball, needle, or any other kind of bearing. In some embodiments, intermediate bearing holder 168*c* may radially extend from the inner surface of seal tube 163 to, for example and without limitation, reduce the size of rotary bearings 179*a* and thrust bearings 179*b* of intermediate bearing 167*c*, which may reduce the overall force exerted on intermediate bearing 167*c* from fluid pressure in annular space 177.

In some embodiments, first seal 171*a* may extend between lower bearing 167*a* and intermediate bearing 167*c*, and second seal 171*b* may extend between intermediate bearing 167*c* and upper bearing 167*b*. One having ordinary skill in the art with the benefit of this disclosure will understand that any number of intermediate bearings 167*c* may be included between lower bearing 167*a* and upper bearing 167*b* with an associated seal 171 positioned therebetween.

In some embodiments, lower bearing 167*a*, upper bearing 167*b*, and intermediate bearing 167*c* may fluidly seal to seal tube 163. In some embodiments, one or more seals 174 may be positioned between lower bearing 167*a* and seal tube 163, between upper bearing 169*b* and seal tube 163, and between intermediate bearing 169*c* and seal tube 163.

In some embodiments, lower bearing 167*a* may include one or more flow paths 175 between the interior of seal tube 163 below lower bearing 167*a* and annular space 177*a* bounded by lower bearing 167*a*, intermediate bearing 169*c*, seal tube 163 and seal 171*a*. The interior of seal tube 163 below lower bearing 167*a* may be in fluid communication with the interior of casing 20. Fluid pressure in annular space 177*a* may act on the exterior of seal 171*a*, causing it to press against drill string 25 and form a seal as depicted in FIG. 8B.

In some embodiments, intermediate bearing 167*c* may include one or more flow paths 175' between annular space 177*a* and annular space 177*b* bounded by intermediate bearing 167*c*, upper bearing 169*b*, seal tube 163 and seal 171*b*. In the event that seal 171*a* fails, fluid may flow from annular space 177*a* and into annular space 177*b*. Fluid pressure in annular space 177*b* may act on the exterior of seal 171*b*, causing it to press against drill string 25 and form a seal.

In some embodiments, when a tool joint enters seal 171*a*, the volume of annular space 177*a* may be reduced as the tool joint presses seal 171*a* outward. Fluid within annular space 177*a* may flow through flow paths 175 of lower bearing 167*a*. As the tool joint passes through seal 171*a*, seal 171*a* may be pressed inward by fluid pressure in annular space 177*a* as the tool joint exits seal 171*a*. In some embodiments, fluid which may pass through seal 171*a* as the tool joint passes therethrough may be contained by seal 171*b*.

In some embodiments, as depicted in FIG. 2, two or more bearing assemblies 165 may be positioned in seal tube 163. Multiple bearing assemblies 165 may, for example and without limitation, provide redundant leak protection. In some embodiments, one or more pressure sensors 181 may be positioned in seal tube 163. In some embodiments, pressure sensors 181 may be positioned between adjacent bearing assemblies 165. In some embodiments, pressure sensors 181 may be used to monitor the condition of bearing assemblies 165 including seals 171. In some embodiments, one or more of temperature and RPM sensors may also be positioned with pressure sensor 181.

Figure 7:
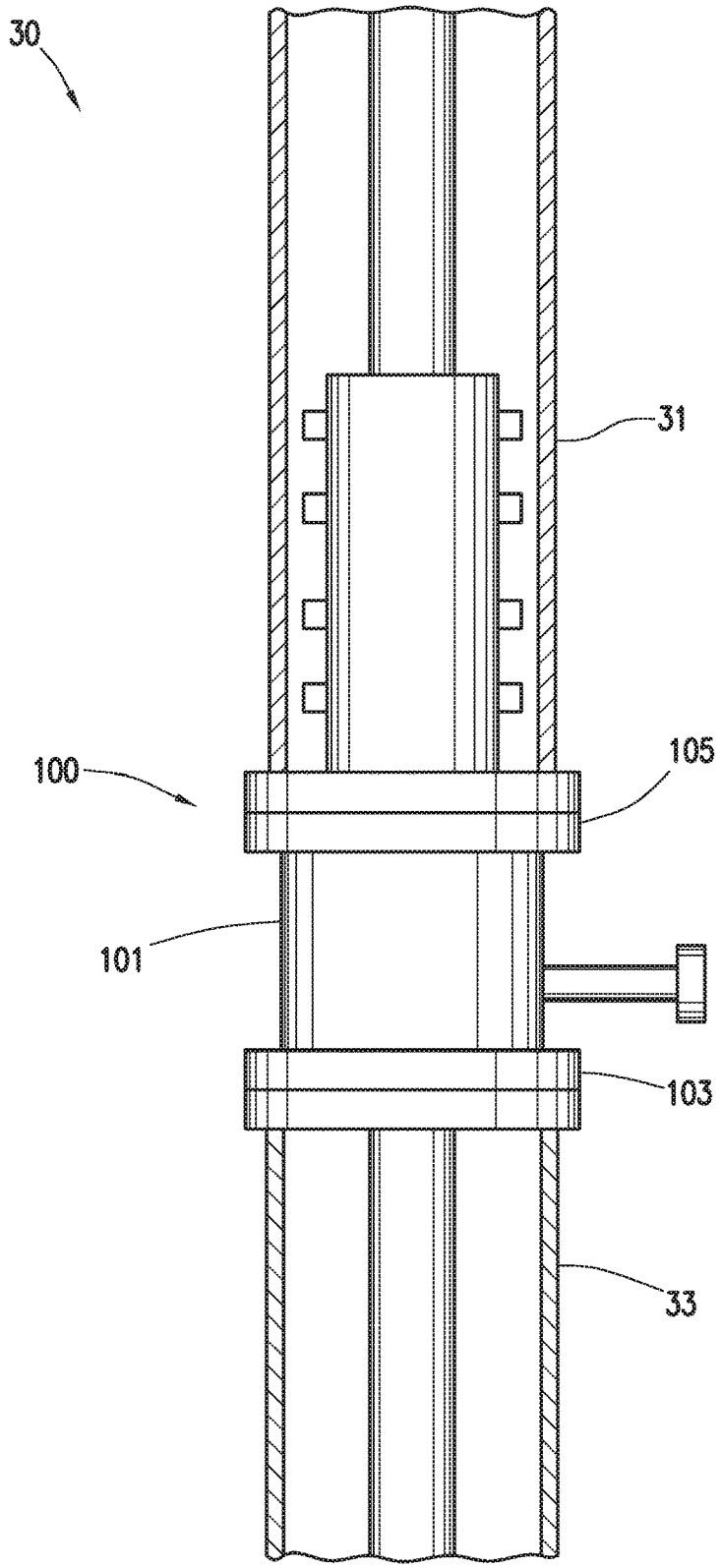
FIG. 7 depicts a riser assembly having an RCD consistent with at least one embodiment of the present disclosure.

Although previously described as being positioned atop BOP stack 10, RCD 100 may be included as part of riser assembly 30 as depicted in FIG. 7. Lower riser section 31 may couple to lower flange 103 of housing 101, and upper riser section 33 may couple to upper flange 105 of housing 101.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A seal tube assembly comprising:

a seal tube, the seal tube having no fluid paths through the wall thereof;

a seal, the seal being tubular;

a first bearing mechanically coupled directly between the seal tube and a first end of the seal; and a second bearing mechanically coupled directly between the seal tube and a second end of the seal;

the first bearing, the second bearing, the seal tube, and the seal defining an annular space about the seal, wherein fluid pressure within the annular space presses the seal radially inward.

2. The seal tube assembly of claim 1, wherein the first bearing comprises a first bearing holder and a first bearing race, the second bearing comprises a second bearing holder and a second bearing race, the first and second bearing holders mechanically coupled to the seal tube and fluidly sealed thereagainst.

3. The seal tube assembly of claim 2, wherein the first end of the seal is mechanically coupled to the first bearing race and the second end of the seal is mechanically coupled to the second bearing race.

4. The seal tube assembly of claim 2, wherein the first bearing comprises a flow path between the interior of the seal tube below the first bearing and the annular space defined by the first bearing, the second bearing, the seal tube, and the seal.

5. The seal tube assembly of claim 1, further comprising:

a second seal, the second seal being tubular, the second seal having a first end and a second end, the first end of the second seal directly coupled to the second bearing; and a third bearing, the third bearing mechanically coupled directly between the seal tube and the second end of the second seal.

6. The seal tube assembly of claim 1, wherein the seal is formed from an elastomeric material.

7. The seal tube assembly of claim 5, wherein the second bearing comprises a flow path between the interior of the seal tube below the second bearing and a second annular space defined by the second bearing, the third bearing, the seal tube, and the second seal.

8. The seal tube assembly of claim 7, wherein fluid pressure within the second annular space presses the second seal radially inward.

9. The seal tube assembly of claim 7, wherein the third bearing does not include a flow path.

10. The seal tube assembly of claim 4, wherein the second bearing does not include a flow path.

* * * * *